United States Patent [19]

Kaneko et al.

[11] 4,345,953

[45] Aug. 24, 1982

[54] ALUMINUM-BASED DIE CASTING ALLOYS

[75] Inventors: Nobuo Kaneko, Minami Magome; Masaru Yamamoto, Tokyo, both of Japan

[73] Assignee: Mitsui Mining & Smelting Co., Ltd., Tokyo, Japan

[21] Appl. No.: 182,312

[22] Filed: Aug. 28, 1980

[51] Int. Cl.[3] ..... C22C 21/06

[52] U.S. Cl. ..... 148/32; 75/146

[58] Field of Search ..... 75/146, 140, 141; 148/32

[56] References Cited

U.S. PATENT DOCUMENTS 4,081,294 3/1978 Thompson et al. ..... 75/146

*Primary Examiner*—R. Dean

*Attorney, Agent, or Firm*—Cushman, Darby & Cushman

[57] ABSTRACT

An aluminum-based die casting alloy for producing high strength, crack free die castings, comprising 4–8% Zn, 6–11% Mg, 0.05–0.45% Ti and/or Zr if desired, and the balance aluminum. In one embodiment, the die casting alloy may further comprise 0.3–2.0% Fe to prevent the die casting alloy in the molten state from eroding the gate and its neighborhood of a die during casting in the die.

9 Claims, 7 Drawing Figures

Figure 1A:
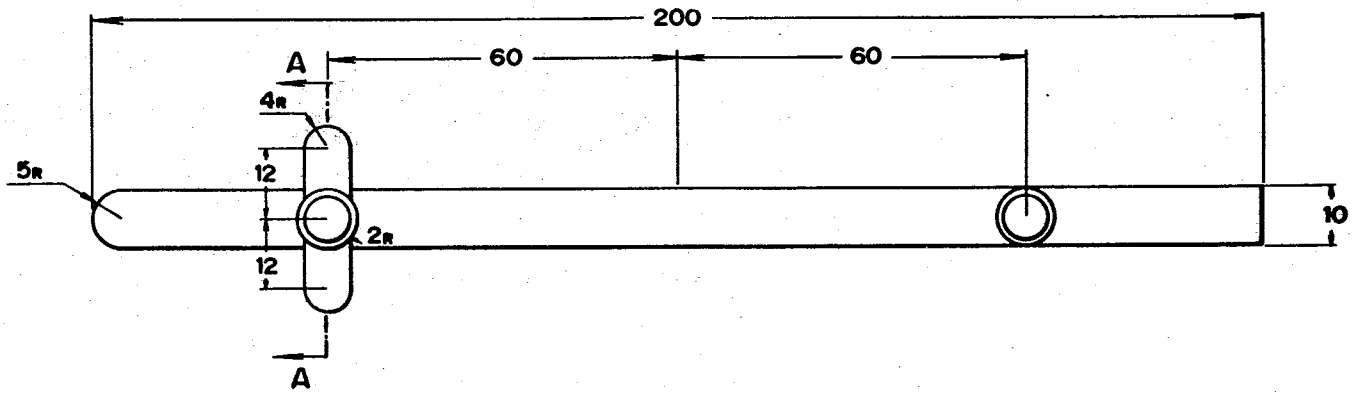

FIG. 3A
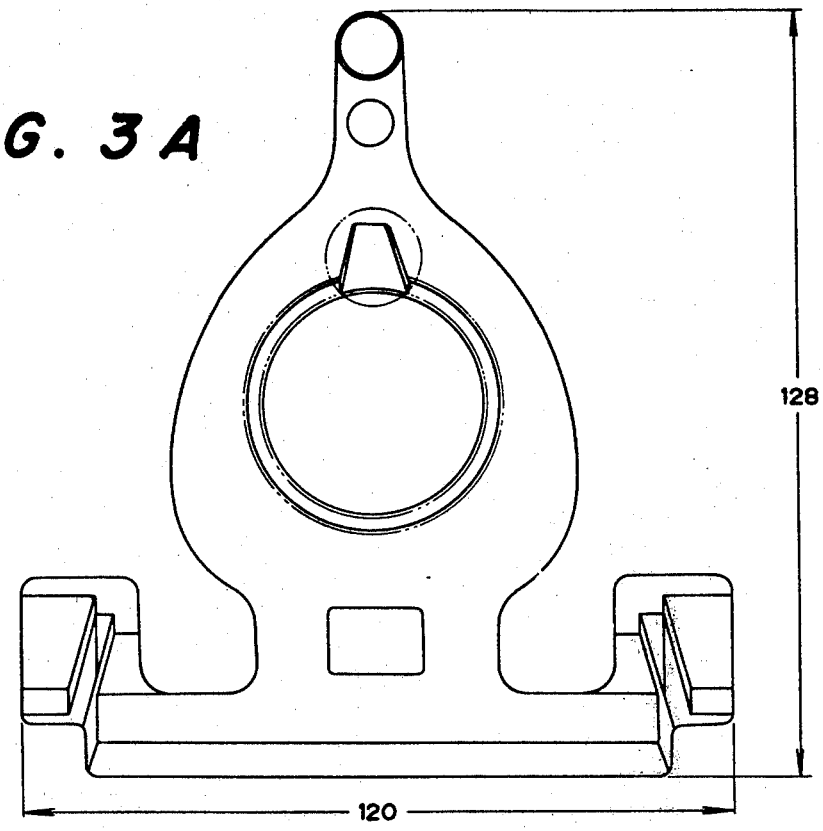
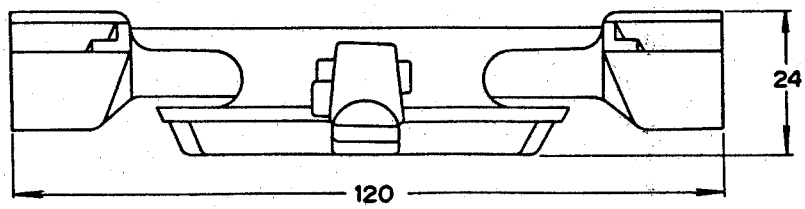
FIG. 3B

FIG. 4A
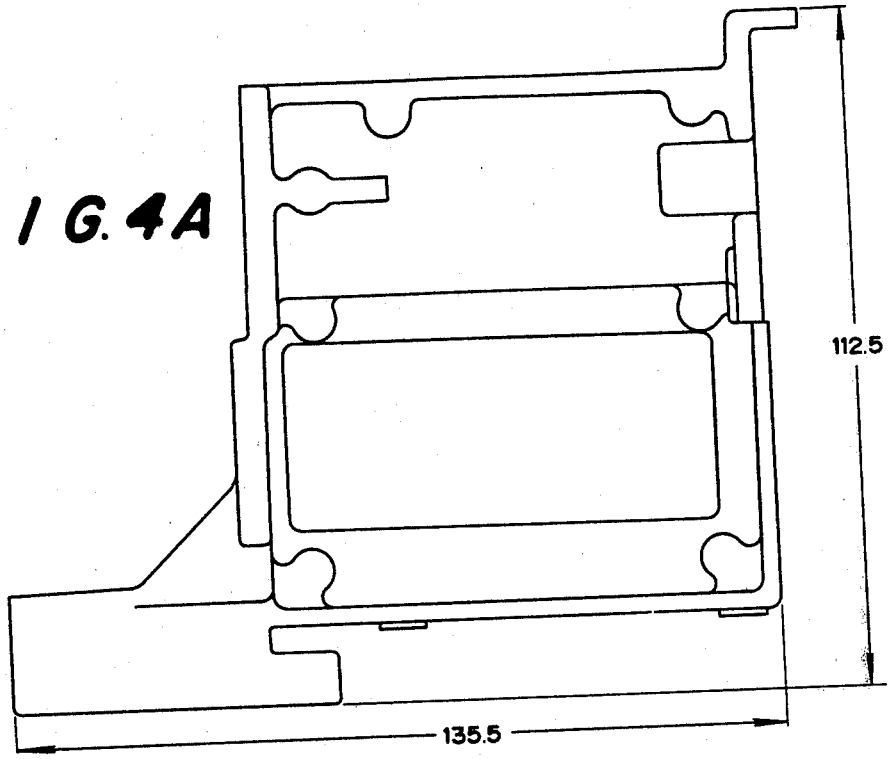
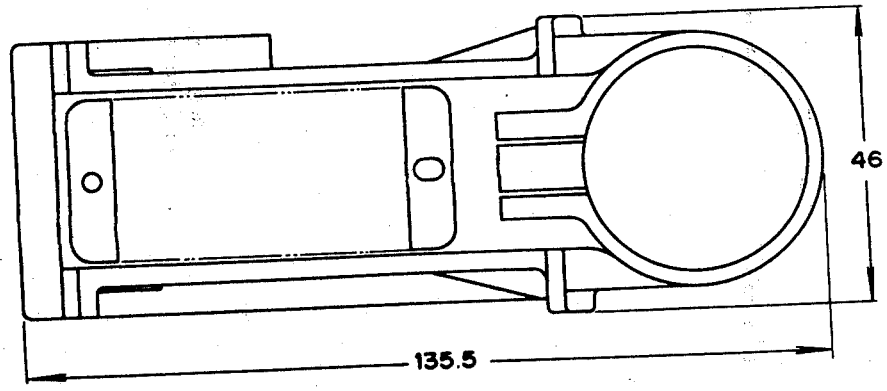
FIG. 4B

ALUMINUM-BASED DIE CASTING ALLOYS

This invention relates to an aluminum-based die casting alloy of Al-Zn-Mg type.

In general, aluminum-based die casting alloys which have been mainly used include Al-Si-Mg type alloys and Al-Si-Cu type alloys. These known alloys are disadvantageous in that they have low strengths such as a tensile strength of 20–30 Kg/mm$^2$ and an yield strength (0.2% yield point) of 10–20 Kg/mm$^2$ and they cannot have their surface properties improved by anodic oxidation or the like. Among the aluminum-based alloys, there are Al-Zn-Mg type alloys which have a tensile strength of at least 50 Kg/mm$^2$ and a yield strength of 40 Kg/mm$^2$ and may be treated to have a transparent oxidized surface; however, they have not been used at all as die casting alloys since they have poor castability and, particularly, tend to cause hot tear cracks.

It would be preferable if the Al-Zn-Mg type alloys could be improved in castability and, particularly, hot tear since they originally have specific properties as aluminum alloys and, if so improved, would find their wide use as substitutes for cast iron. In view of this, the present inventors made various studies in an attempt to obtain such improved Al-Zn-Mg type alloys and, as the result of their studies, they found that said requirements are met by new aluminum-based die casting alloys consisting of, by weight, 4–8% of Zn, 6–11% of Mg and the balance being aluminum. The term "aluminum or Al" used herein is intended to mean pure aluminum or aluminum containing incidental impurities such as Si, Fe, Cu, Mn and Sn.

As compared with conventional ADC-12 alloys, the new aluminum-based die casting alloys have the same or superior mechanical properties and also have a surface which may be easily treated, for example, to form thereon a transparent oxide film thereby to make the surface stable or unchanged in color. Further, they have more satisfactory wear resistance than ADC-12 alloys (Al-Si type alloy, JIS ADC-12).

However, when the new aluminum-based alloys (three component alloys) are subjected to almite treatment after having been cast in a die, they are likely to produce about 0.2 mm deep linear cracks at their portions on which flow lines and cold shut are formed during the die casting, whereby they not only degrade in appearance but also decrease in yield of final product. This is especially true with die cast products having a complicated configuration. From the fact that these cracks may be much lessened by heat treating (annealing) the die cast alloys at a low temperature to relieve them of their stress, it is surmised that such cracks are resulted from a kind of stress corrosion caused during the application of electric current in an acid solution for almite treatment.

As the result of their further studies, the present inventors also found that such cracks which are drawbacks to be appreciated especially in the complicatedly shaped three-component alloys after the almite treatment, may be eliminated by adding a small amount of Ti and/or Zr to the three-component alloys thereby forming four-component alloys. Furthermore, during their further studies, they further found that when especially complicatedly shaped alloys are obtained by die casting, the gate and its surrounding portions of the die tend to be eroded and that such erosion may be avoided by using five-component alloys obtained by adding a small amount of Fe to the four-component alloys. The four-component alloys are those comprising 4–8% by weight of Zn, 6–11% by weight of Mg, 0.05–0.45% by weight of at least one of Ti and Zr, and the balance aluminum. The five-component alloys are those prepared by adding 0.3–2.0% by weight of Fe to the four-component alloys.

An object of this invention is to provide an aluminum-based die casting alloys suitable for use in producing die cast alloy products having high strength without hot cracks, comprising 4–8% by weight of Zn, 6–11% by weight of Mg and the balance aluminum.

Another object of this invention is to provide an aluminum-based die casting alloys suitable for use in producing die cast alloy products having high strength, no hot cracks and no cracks due to almite treatment if so treated, comprising 4–8% by weight of Zn, 6–11% by weight of Mg, 0.05–0.45% by weight of at least one member selected from the group consisting of Ti and Zr, and the balance aluminum.

A still another object of this invention is to provide an aluminum-based die casting alloys suitable for use in producing die cast alloy products having high strength, no hot cracks, no other cracks due to almite treatment if so treated, and no erosion on the gate and its surrounding portions of a die used, comprising 4–8% by weight of Zn, 6–11% by weight of Mg, 0.05–0.45% by weight of at least one member selected from the group consisting of Ti and Zr, 0.3–2.0% by weight of Fe and the balance aluminum.

All the percentages appearing in the specification are by weight unless otherwise specified.

The reason why the amounts of Zn and Mg used in the die casting alloys of this invention are limited respectively to 4–8% and 6–11% is that the use of these metals in amounts respectively outside said ranges will result in producing hot cracks in the resulting die cast alloys.

The use of Ti and/or Zr in amounts of less than 0.05% will be less effective in preventing the resulting die cast alloys after the almite treatment thereof from producing cracks, while the use thereof in amounts of more than 0.45% will not increase the crack-preventing effect in the resulting die cast alloys and will decrease the castability and mechanical properties thereof, this being undesirable. The preferable amount of Ti and/or Zn used is in the range of 0.1–0.3%. Ti and Zr are equally effective in preventing the resulting die cast alloys having been subjected to almite treatment from producing cracks therein.

Further, Fe is effective in preventing a die used from being eroded and is contained in an amount of 0.3–2.0% in the die casting alloy of this invention. The use of Fe in an amount of less than 0.3% is ineffective, while the use thereof in an amount of more than 2.0% will result in degrading the resulting die cast alloy in mechanical properties.

Figure 1B:
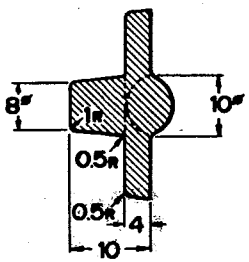
Figure 2:
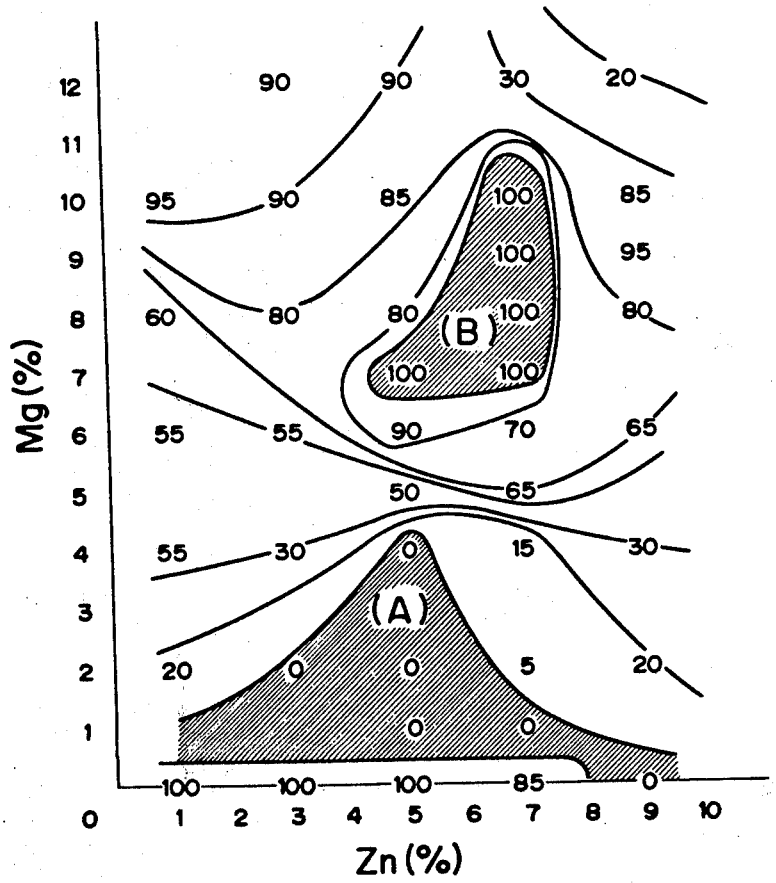

FIG. 1 shows the shape of a test piece to be tested for hot cracks, FIG. 1(A) being a plan view of the test piece and FIG. 1(B) a sectional view taken along the line A—A in FIG. 1(A), FIG. 2 is a graph showing the variation of rate in % of production of crack-free die castings with a change in ratio of Zn/Mg in aluminum-based Al-Zn-Mg type die casting alloys, FIG. 3 shows the shape of product I obtained by casting in a corresponding die, FIG. 3(A) being an elevation of the product I and FIG. 3(B) a plan view thereof, and FIG. 4 shows the shape of product II obtained by casting in a corresponding die, FIG. 4(A) being an elevation of the product II and FIG. 4(B) a plan view thereof.

The methods of test for hot cracks and the like of Al-Zn-Mg type aluminum-based die casting alloys, and the test results, were described hereinbelow.

EXAMPLE 1

(I) Method of Experiments

(1) Test for hot crack resistance using test pieces

In confirmation of the advantages of this invention, there were made tests for hot crack resistance using test pieces (FIG. 1) which were detailed later. In the practice of such tests, annular dies as proposed by Singer and Jennings have heretofore been used and the degree of hot cracking is determined from the length of cracks formed around the surface of the resulting die casting corresponding to the annular surface of the annular die.

In the test of this Example, on the other hand, there were firstly manufactured dies for producing rods provided thereon with bosses at an interval of 120 mm as shown in FIG. 1. Various aluminum-based Al-Zn-Mg alloys containing the Zn and Mg in different ratios by weight (Zn/Mg ratios) were each melted and repeatedly cast in the thus manufactured die to produce 20 rods. It was then observed how many of the thus die cast alloys were obtained as crack free rods without creating hot cracks due to the shrinking force generated in the longitudinal monoaxial direction between the bosses, thus finding the degree of hot crack resistance (hereinafter referred to as "crack free ratio") expressed by the following formula:

$$\text{Crack free ratio (\%)} = \frac{\text{No. of crack free rods after test}}{\text{Total No. of rods tested}} \times 100\%$$

(2) Melting and Casting

In each run, aluminum of 99.8% purity was firstly melted in a graphite crucible and a predetermined amount of each of Mg and Zn was charged and melted therein to obtain various Al-based alloys having their respective compositions as shown in FIG. 2. In this case, the element (Mg) having a lower specific gravity than pure aluminum, or a mother alloy (Al-rich Al-Mg alloy), after having been wrapped in an aluminum foil, were placed in an immersion jig which was immersed in the molten aluminum to melt said element or mother alloy therein, after which the whole mass was subjected to flux treatment. Materials for the Al, Zn and Mg melted were as follows:

| | | | |
|---|---|---|---|
| Material for the Al JIS-H-2102 | No. 1 | 99.8% | Al |
| Material for the Mg JIS-H-2150 | No. 2 | 99.8% | Mg |
| Material for the Zn JIS-H-2107 | Ordinary zinc ingot | 99.99% | Zn |

The Al-Zn-Mg die casting alloys so obtained were each die cast (or cast in a die) to obtain 20 die castings (about 3.6 Kg in total) as detailed below.

Each of these die casting alloys was melted in a graphite crucible and then cast by the use of a 250-ton cold chamber type die casting machine manufactured by Toshiba Electric Co. Ltd. In casting the alloys, there were used I-type and II-type dies having the shapes corresponding respectively to those of castings I and II as shown in FIGS. 3 and 4 although they were those which were originally suited for casting ADC-12 alloys and the like conventional alloys, not well suited for the alloys of this invention. The ADC-12 alloys are Al-based alloys comprising the following: 1.5–3.5% Cu, 9.5–12.0% Si, <0.3% Mg, <1.0% Zn, <1.3% Fe, <0.5% Mn, <0.5% Ni, <0.3% Sn and the balance aluminum.

The casting conditions were summarized as follows.

| Casting Conditions | |
|---|---|
| 250 ton cold chamber type die casting machine used | |
| Graphite crucible used | |
| Temperature of melted alloy: | 700–800° C. |
| Release agent: | Oily Caster Ace No. 15 (produced by Kyodo Kikaku Co.) |
| Temperature of die: | 140–180° C. |
| Shot cycle: | 28–39 sec/cycle |

(3) Casting test (i) Products I obtained by casting in the I-type die

The products I had a good casting surface without hot cracks.

In general, in a case where Al-Mg type alloys (JIS ADC-5) and the like which will exhibit poor fluidity or flowability in the molten state are cast in a die, the gate area of the die should be 1.5–2.0 times as large as that of a die in which ADC-12 alloys (Al-Si type alloy) are cast, to prevent sintering while facilitating the flow of said Al-Mg type alloys and the like. In a case where the products I were produced while preventing them from sintering, the gate of the I-type die used was not permitted to be enlarged because of their mass production.

(ii) Products II obtained by casting in the II-type die

The products II were among the most complicatedly shaped die castings and were satisfactory in compactness. Some of 20 products II had cracks at the portion corresponding to the ring-shaped portion which was positioned farthest from the gate and permitted the molten alloy to flow therethrough during casting operation, the cracks being due to insufficient filling of the molten alloy in the II-type die having complicated configuration. However, they had no hot cracks.

In producing the products II by casting in the II-type die, the gate of the die was not permitted to be enlarged as in the case of the products I. Thus, if there has been used such a die having a gate the size of which was so differentiated from that for ADC-12 alloys (Al-Si alloys) as to be well suited for the die casting alloys of this invention (It is a common sense for die casting technologists to vary the size of gate of a die used depending on the material of alloys to be cast in the die), there would have been obtained satisfactory die castings having neither hot cracks nor cracks due to insufficient filling of the molten alloy in the die during casting.

(II) Results of Experiments

Variation of crack free ratio with a change in ratio of Zn/Mg in aluminum

The variation of crack free ratio with a change in ratio of Zn to Mg in aluminum is as shown in FIG. 2.

In FIG. 2, the numerals indicate "crack free ratios" in % represented by the following formula:

$$\text{Crack free ratio (\%)} = \frac{\text{No. of crack free die castings}}{\text{Total No. of die castings tested}} \times 100\%$$

For example, a crack free ratio of 100 (%) means that all of the die castings are free of hot cracks, while a crack free ratio of 0 (%) means that all of them have hot cracks.

As is apparent from FIG. 2, aluminum-based die casting alloys (4–8% of Zn, 6–11% of Mg and the balance aluminum) of this invention may be die cast (cast in a die) to produce die castings having no hot cracks. Further, the conventional die casting alloys (0–6% Zn and the balance aluminum) which do not contain Mg, will neither create cracks when being die cast. Aluminum-based alloys which are most likely to create cracks when being die cast, have compositions within the region (5% Zn–4% Mg as the peak) indicated by the symbol (A) in FIG. 2. In addition, aluminum-based alloys (at least 8% of Zn, 0% of Mg) will create cracks when being die cast.

The comparison of properties between the novel die casting alloys of this invention and the known ADC-12 alloys (Al-Si type alloys), is shown in the following Table 1.

TABLE 1

Comparison of properties between novel alloys and ADC-12 alloys

| | | ADC-12 alloys (produced by Mitsui) | Novel alloys (produced by Mitsui) |
|---|---|---|---|
| Surface treatment | Anodic oxidation | Brown-gray colored (Thin film) | White colored, transparent (Thick film) |
| | Boehmite | Brown-gray colored (Thin film) | White colored, transparent (Thick film) |
| Corrosion resistance | | Unsatisfactory | Satisfactory Copper acetate spray test, brine spray test, air exposure test |
| Castability | Hot tear crack | None | None |
| | Surface appearance | Satisfactory | Satisfactory |
| | Flow of molten metal and filling property thereof | Satisfactory | Satisfactory |
| Mechanical properties | Tensile strength | 28 Kg/mm$^2$ | 28 Kg/mm$^2$ |
| | Hardness (Vickers) | 100 | 150 |

Note:
The tests were made in accordance with JIS (Japanese Industrial Standard).

(III) Observations

Effects of Zn/Mg ratio

Aluminum-based alloys now used are roughly classified into four kinds which are Al-Cu type, Al-Mg type, Al-Si type and Al-Zn type alloys, among which only the Al-Zn type alloys are not used as a die casting alloy. The reason for this is that the Al-Zn alloys will remarkably create hot cracks when being die cast. If an Al-Zn type die casting alloy is die cast to produce a die casting in which the excessively precipitated Zn atoms are present in the form of $AlZn_2$ or the like or in the form of soft intermetallic compounds (in the region of about 1–7% of Zn with a crack free ratio of 100 as shown in FIG. 2), the die casting so produced will not have hot cracks. However, if such an Al-Zn type die casting alloy is incorporated with a small amount of Mg and then die cast, the resulting die casting will create cracks probably because a hard Mg-containing intermetallic compound (such as $AlMg_2Zn$) is formed in the die casting thereby to make the die casting lose its viscosity. If such an Al-Zn type die casting alloy is incorporated with a more amount of Mg and then die cast, not only an intermetallic compound but also Mg alone is precipitated in the resulting die casting thereby to make the die casting viscous (the region of 4–8% of Zn and 6–11% of Mg with a crack free ratio of 100 (%) as shown in FIG. 2).

From the above experimental results, it is seen that the aluminum-based Al-Zn-Mg type die casting alloys of this invention will give high-strength and hot crack-free die castings.

EXAMPLE 2

The following main starting materials were melted in a graphite crucible.

| | | | |
|---|---|---|---|
| Al material JIS-H-2102 | No. 1 | 99.8% | (purity) |
| Mg material JIS-H-2150 | No. 2 | 99.8% | (purity) |
| Zn material JIS-H-2107 | Ordinary zinc ingot | 99.99% | (purity) |

The Mg material having a lower specific gravity than the Al material was wrapped in aluminum foil, placed in an immersion jig and then melted in the previously molten Al-Zn bath, after which the whole was subjected to treatment with flux to obtain an Al-Zn-Mg alloy.

In this Example, Zn and Mg were used in varying amounts within the scope of this invention and at least one of Ti and Zr was also used in varying amounts in preparing various die casting alloys. The various die casting alloys so prepared were each die cast under the following conditions to prepare test pieces (as-cast weight, 150 g each; finished weight, 60 g) which were then subjected to almite treatment by the use of a sulfuric acid method.

| Casting conditions | |
|---|---|
| 250 ton cold chamber machine used | |
| Graphite crucible used | |
| Temperature of melted alloy | 700–720° C. |
| Release agent | Aqueous Hiclean No. 3-A produced by Kyodo Kikaku Co. Ltd. |

-continued

| Casting conditions | |
|---|---|
| Temperature of die | 140–180° C. |
| Cycle | 28–39 sec. |

The test pieces so subjected to almite treatment were investigated to find how many (in %) of them had not cracks, that is, to find the crack free ratios (in %) of number of crack free pieces to the total number of pieces tested. The results are as follows.

The use of 0.04% of at least one of Ti and Zr led to a crack free ratio of 70%, the use of 0.05–0.45% thereof led to a crack free ratio of 85%, particularly the use of 0.1–0.3% lead to 95% and the use of more than 0.45% led to a sharply decreased crack free ratio of 60%.

From these results it is seen that the addition of 0.05–0.45%, preferably 0.1–0.3%, of at least one of Ti and Zr to the Al-Zn-Mg type die casting alloy of this invention will be effective in preventing the resulting die cast alloy from corrosion due to strain remaining therein, caused during the application of electric current through an acid solution at the time of almite treatment, whereby crack formation is prevented and consequently a yield of products is greatly increased.

EXAMPLE 3

Al, Zn, Mg, Ti and/or Zr were melted in the same manner as in Example 2 to form a melted metallic mass in which Fe is then melted. The whole mass was cast in a die for autobicycle winkers (as-cast weight, 200 g each; product winker weight, 100 g each).

| Casting conditions | |
|---|---|
| 250 ton cold chamber machine used | |
| Graphite crucible used | |
| Temperature of melted alloy | 700–720° C. |
| Release agent | Aqueous Hiclean No. 3-A |
| Temperature of die | 170–200° C. |
| Cycle | 25–30 sec. |

In this Example, Fe was used in varying amounts to obtain various die casting alloys for test. The said die was such that the use thereof as a die for die cast makes it apprehensible whether the casting conditions are suitable or unsuitable from the view-point of castability, particularly subsequent surface treatment. The various die casting alloys so obtained were each cast in this die as many times as indicated in Table 2 to find whether or not the die erosion by the molten alloy took place. The results are as shown in Table 2.

TABLE 2

| Composition of die casting alloy | Die erosion or no die erosion | Anodic oxidizability |
|---|---|---|
| Al—8.5%Mg—6.0%Zn—0.3%Ti—0.1%Fe | Die erosion clearly appreciated after about 60 shots | Satisfactory |
| Al—8.5%Mg—6.0%Zn—0.3%Ti—0.3%Fe | No die erosion even after 200 shots | " |
| Al—8.5%Mg—6.0%Zn—0.3%Ti—0.8%Fe | No die erosion even after 500 shots | " |
| Al—8.5%Mg—6.0%Zn—0.3%Ti—1.8%Fe | No die erosion even after 500 shots | " |

The properties of the die casting alloys of Example 1 (Al—6.0% Zn—8.5% Mg), Example 2 (Al—6.0% Zn—8.5% Mg—0.3% Ti) and Example 3 (Al—6.0% Zn—8.5% Mg—0.3% Ti—1.8% Fe) were compared with those of ADC-12 alloy. Each comparison test was made in accordance with JIS (Japanese Industrial Standard).

TABLE 3

| | | ADC-12 alloy | Alloy of Example 1 | Alloy of Example 2 | Alloy of Example 3 |
|---|---|---|---|---|---|
| Surface treatment | Anodic oxidation | Gray-brown colored (Thin film) | White-colored and transparent (Thick film), Microfissure appreciated in case of complicated shape | White-colored and transparent (Thick film), No microfissure appreciated even in case of complicated shape | White-colored and transparent (Thick film), No microfissure appreciated even in case of complicated shape |
| | Boehmite | Gray-brown colored (Thin film) | White-colored and transparent (Thick film) | White-colored and transparent (Thick film) | White-colored and transparent (Thick film) |
| Erosion resistance | | Unsatisfactory to erosion in cass test, | Satisfactory resistance to erosion in cass test, s.s.t. and air exposure test | Satisfactory resistance to erosion in cass test, s.s.t. and air exposure test | Satisfactory resistance s.s.t. and air exposure test |
| Castability | Hot tear crack | None | None | None | None |
| | Surface appearance | Satisfactory | Satisfactory | Satisfactory | Satisfactory |
| | Flow and Filling capability of molten alloy | Satisfactory | Satisfactory | Satisfactory | Satisfactory |
| | Die erosion | None | Die erosion took place in case of complicated shape | Die erosion took place in case of complicated shape | None |
| Mechanical properties | Tensile strength | 28 Kg/mm$^2$ | 28 Kg/mm$^2$ | 28 Kg/mm$^2$ | 24 Kg/mm$^2$ |
| | Hardness (Vickers) | 100 | 150 | 150 | 150 |

Note:
cass test = copper acetate spray test
s.s.t. = salt spray test

As is seen from the foregoing, the aluminum-based die casting alloys of this invention have the following features and advantages:

(1) The aluminum-based die casting alloys may be molded, particularly die cast, to obtain die castings having no hot cracks, (2) They may flow as well as ADC-12 alloys and may be fully filled even in a complicatedly shaped die when melted, (3) They may be easily subjected to surface treatment (inter alia transparent surface treatment) remarkably unlike conventional ADC alloys, to obtain stable nondiscolored products having better wear resistance than ADC-12 alloys, (4) They have mechanical properties which are approximately equal to, or better than, those of ADC-12 alloys, (5) They may give die castings which will not create cracks even by the almite treatment thereof in a case where they comprise Ti and/or Zr in addition to Zn, Mg and Al, and (6) They will not erode the gate and its neighborhood of a die during casting in the die in a case where they comprise Fe in addition to Zn, Mg, Ti and/or Zr, and aluminum.

What is claimed is:

1. A die cast product having high strength and free from hot cracks made from an aluminum-based die casting alloy consisting essentially of 4–8% by weight of Zn, 6–11% by weight of Mg and the balance aluminum.

2. A die cast product having high strength, free from hot cracks and free from other cracks due to almite treatment made from an aluminum-based die casting alloy consisting essentially of 4–8% by weight of Zn, 6–11% by weight of Mg, 0.05–0.45% by weight of at least one member selected from the group consisting of Ti and Zr, and the balance aluminum.

3. A die cast product having substantial strength, free from hot cracks and free from other cracks due to almite treatment produced without erosion on the gate and its surrounding portions of a die casting machine used, from an aluminum-based alloy consisting essentially of 4–8% by weight of Zn, 6–11% by weight of Mg, 0.05–0.45% by weight of at least one member selected from the group consisting of Ti and Zr, 0.3–2.0% by weight of Fe and the balance aluminum.

4. A process for producing a die cast product having high strength and free from hot cracks, comprising the steps of:

(a) melting an aluminum-based die casting alloy consisting essentially of 4–8% by weight of Zn, 6–11% by weight of Mg and the balance aluminum, (b) shooting the thus melting alloy into a chamber-type die casting machine, and then (c) withdrawing the cooled die cast alloy from the die casting machine to obtain the resulting high strength die cast product free from hot cracks.

5. A die cast product having high strength and free from hot cracks cast from an aluminum-based die casting alloy consisting essentially of the zinc and magnesium contents defined by area B of FIG. 2 and the balance aluminum.

6. A die cast product having high strength and free from hot cracks cast from an aluminum-based die casting alloy consisting essentially of about 8.5 to 11% by weight of magnesium, about 4 to 8% by weight of zinc and the balance aluminum.

7. The die cast product of claim 5 or 6 wherein the magnesium content is about 8.5% by weight.

8. The die cast product of claim 5 or 6 wherein the zinc content is in the range of about 6 to 8% by weight.

9. The die cast product of claim 7 wherein the zinc content is about 6% by weight.

* * * * *